US005746226A

United States Patent [19]

Beaver

[11] Patent Number: 5,746,226

[45] Date of Patent: May 5, 1998

[54] GROOVED SMOKING PIPES AND METHOD OF FILLING

[76] Inventor: George M. Beaver, 4190 Ridgewood Ave., Port Orange, Fla. 32127

[21] Appl. No.: 734,105

[22] Filed: Oct. 21, 1996

[51] Int. Cl.[6] ..... A24F 5/00

[52] U.S. Cl. ..... 131/226; 131/220

[58] Field of Search ..... 131/226, 229, 131/220, 196, 204, 205, 214, 228

[56] References Cited

U.S. PATENT DOCUMENTS

| | | | |
|---|---|---|---|
| 2,246,717 | 6/1941 | Brandon | 131/226 |
| 3,246,656 | 4/1966 | Birch | 131/226 |
| 3,707,154 | 12/1972 | Recht | 131/226 |
| 4,213,469 | 7/1980 | Ramsay | 131/226 |
| 4,687,005 | 8/1987 | Moore | 131/226 |
| 4,870,979 | 10/1989 | Browning et al. | 131/226 |

FOREIGN PATENT DOCUMENTS

| | | | |
|---|---|---|---|
| 408988 | 11/1909 | France | 131/226 |
| 20289 | 9/1899 | Switzerland | 131/226 |
| 2532 | of 1859 | United Kingdom | 131/226 |

*Primary Examiner*—Vincent Millin
*Assistant Examiner*—Charles W. Anderson
*Attorney, Agent, or Firm*—Paul S. Rooy

[57] ABSTRACT

Grooved pipes incorporating a bowl tobacco bore communicating with a groove, the groove communicating with a bowl smoke bore through a bowl smoke bore mouth, and a method of filling a pipe with tobacco. Groove configurations may include a V-groove or an attic groove. The method of filling includes the steps of filling a pipe loosely with tobacco, tamping the tobacco in a direction opposite the bowl smoke bore mouth, repeating as necessary, and then pressing down on a center of tobacco within the bowl tobacco bore until slight effort is required to draw on the pipe. In addition, a cylindrical tobacco insert having a tobacco insert plenum is disclosed. The tobacco insert may rest on a bowl tobacco bore ledge, or on a conical bowl tobacco bore lower surface.

9 Claims, 4 Drawing Sheets

FIG 1
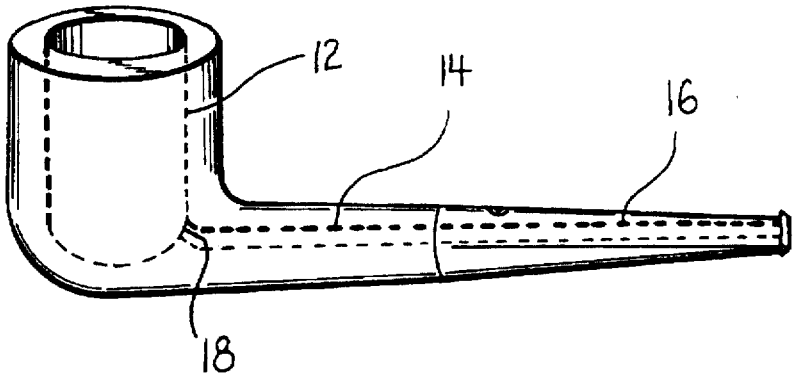
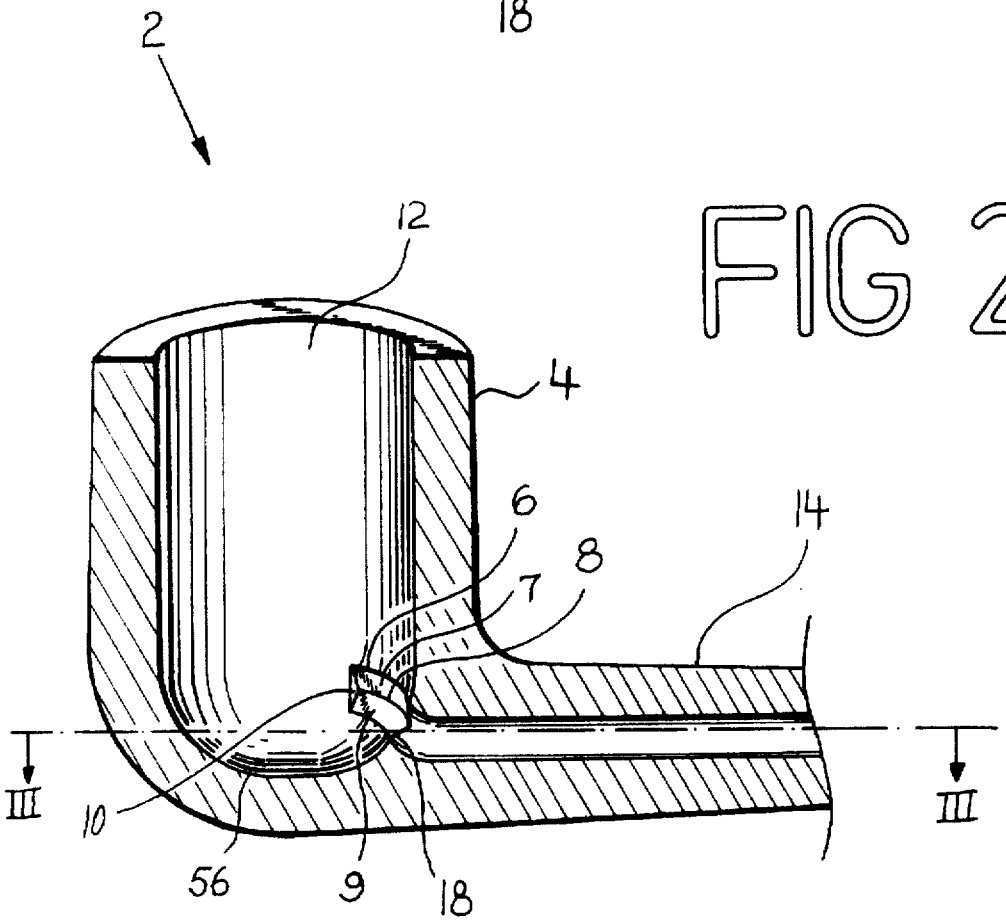
FIG 2

FIG 7
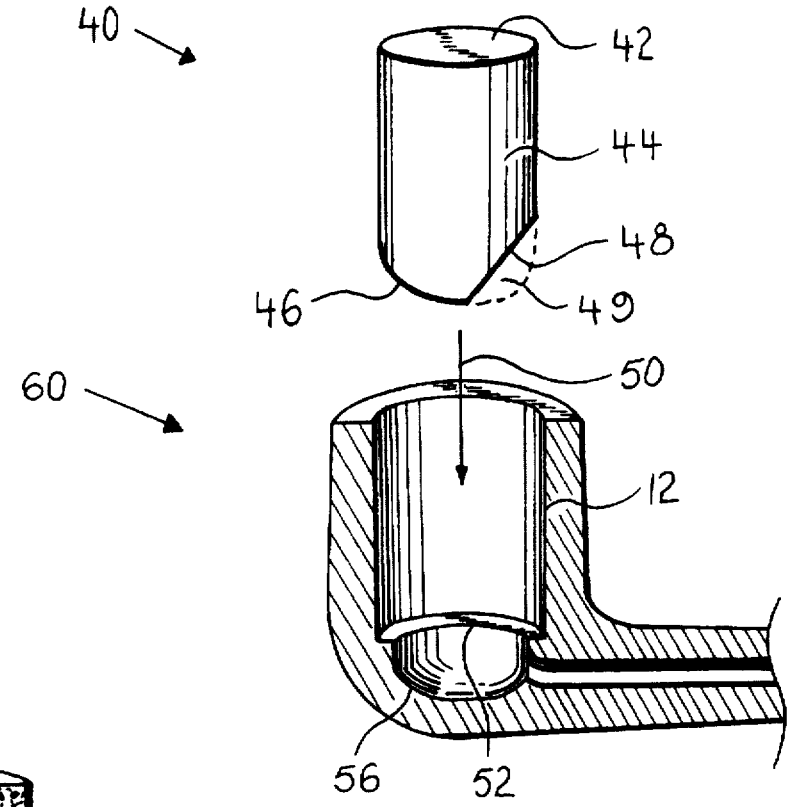
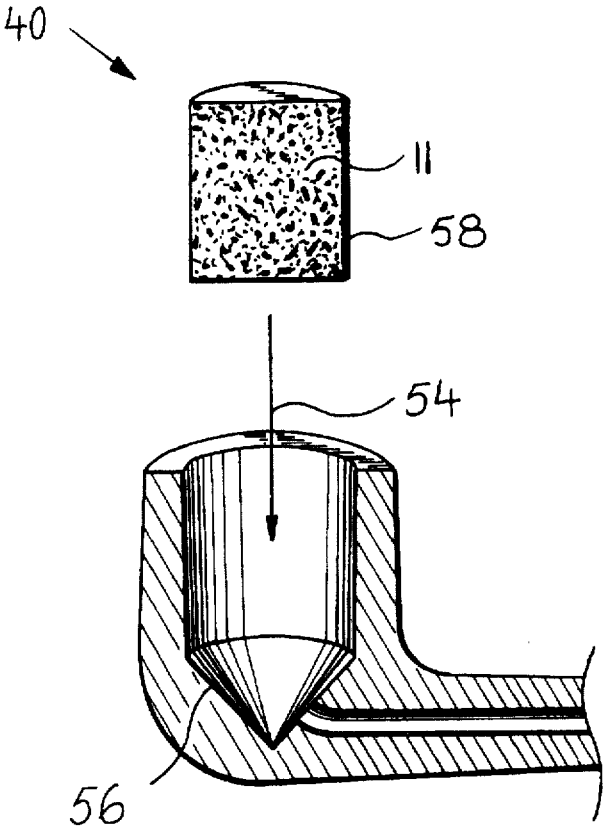
FIG 8

GROOVED SMOKING PIPES AND METHOD OF FILLING

BACKGROUND OF THE INVENTION

1. Field of the Invention

This invention relates to smoking pipes, and in particular to grooved smoking pipes and method of filling same with tobacco.

2. Background of the Invention

The pastime of pipe smoking has been in existence for centuries. It is believed that pipes had been used in Europe for smoking medicinal herbs for many years before tobacco smoking was introduced there. Tobacco smoking began with the American Indians, who introduced tobacco pipes to white settlers. The Indians smoked tobacco in a ceremonial peace pipe, or calumet. In 1586 Sir Ralph Lane, the commander of a colony in Virginia, introduced tobacco pipe smoking to Europe by sending a tobacco pipe to Sir Walter Raleigh. Legend relates that when Sir Walter Raleigh's servant saw him smoking for the first time, he threw a bucket of water on Sir Raleigh, because he thought his master was on fire!

Over the years, tobacco pipe smoking has enjoyed consistent popularity. During recent decades, tobacco pipe smoking has experienced a resurgence in popularity, in part due to the increased public awareness of the health hazards of cigarette smoking.

Existing Designs

Conventional tobacco pipes incorporate a bowl attached to a stem. Typically the stem is removable from the bowl for cleaning. The bowl is generally made from brier root, which grows near the Mediterranean coast. These roots frequently have a beautiful grain, and are extremely hard and heat resistant. Other pipe bowls are made of corncob, clay, porcelain, or meerschaum (a clay-like material). Most pipe stems are made of hard rubber, plastic, or wood. Generally the stem is frictionally engaged with the bowl, so that the stem may be removed from the bowl using a twisting, pulling motion.

The pipe bowl features a bowl tobacco bore which is filled with tobacco for smoking, which communicates with a bowl smoke bore through a bowl smoke bore mouth at the intersection of the bowl tobacco bore and the bowl smoke bore. The stem incorporates a stem bore in communication with the bowl smoke bore at one extreme and a mouthpiece at another extreme. In this manner, smoke produced by virtue of tobacco combustion occurring in the bowl tobacco bore travels through the bowl smoke bore mouth to the bowl smoke bore, and thence through the stem bore to the mouthpiece, where it is available for use by the smoker.

There are a number of problems associated with current tobacco pipe designs. One problem is the small size of typical bowl smoke bore mouths. As may be observed in FIG. 1, conventional pipes incorporate bowl tobacco bore 12 which communicates with stem bore 16 through bowl smoke bore mouth 18 and bowl smoke bore 14. The size of bowl smoke bore mouth 18 is typically very small compared to the surface area of tobacco burning within bowl tobacco bore 12. Consequently bowl smoke bore mouth 18 generally becomes a bottleneck to smoke, combustion byproducts, and tobacco fragments. This bottleneck leads to a number of problems. One problem is that bowl smoke bore mouth 18 tends to clog with tobacco fragments, liquefied nicotine and tars, and other combustion byproducts. This causes the pipe draw to become difficult, thus negatively impacting the smoker's enjoyment. In addition, if the clogging becomes extreme, the pipe may actually go out, necessitating that the smoker re-light the pipe. Another problem associated with the current small bowl smoke bore mouths is that as the tobacco in the pipe bowl bore burns down, the restricted draft available through the bowl smoke bore requires the smoker to tamp down the tobacco within the pipe bowl numerous times during each pipe smoked. This laborious tamping requirement is time-consuming and inconvenient. Sometimes the clogging of the bowl smoke bore mouth is sufficiently severe to compel the smoker to poke a reamer down through the tobacco in the pipe bowl to the bowl smoke bore mouth, in order to clear a passageway so that tobacco combustion can continue within the pipe bowl.

Finally, the bowl smoke bore mouth bottleneck is easily clogged, and thus requires frequent cleanings on the part of the smoker. The tobacco pipe cleaning process is laborious and time consuming. First the pipe must be emptied. Then the bowl must be disassembled from the stem. Then the bowl tobacco bore is cleaned. The next step is to clean out the bowl smoke bore, generally by reaming it out with a pipe cleaner. Special attention must be given to ensure the critical bowl smoke bore mouth is thoroughly cleaned. Then the stem bore must be cleaned, generally by reaming it out with a pipe cleaner. Finally, the bowl must be re-assembled to the stem. Thus, the current bowl smoke bore mouth bottleneck designs demand frequent pipe cleanings.

Another set of problems associated with current pipe designs is and methods of use is the difficulty of filling a pipe. Typically, the smoker must locate the pipe and tobacco. The tobacco is generally located either in a pouch or a can. The pipe is introduced into the tobacco container, and filled with tobacco. Then the tobacco is tamped down with a tamping tool, and then the pipe may be required to be refilled and re-tamped, possibly a number of times. The tamping operations generally force tobacco into the bowl smoke bore mouth, and thus the bottleneck problem referred to above may exist even before the smoker lights the pipe. In addition, if the tobacco is tamped too much, the tobacco will be packed too tightly, and excessive effort will be required of the smoker due to the hard draw that tightly packed tobacco provides. On the other hand, if the tobacco is tamped too loosely, then the pipe will go out instead of remaining alight for the duration of the bowl.

A final set of problems associated with current tobacco pipe use is the bowl smoke bore mouth clogging that can occur when a pipe is emptied. If the pipe is emptied from front to back, using a pipe tool, the action of scooping out the combustion residue can actually further clog the bowl smoke bore mouth. This clogging can render the pipe difficult to use, or even necessitate a complete pipe cleaning.

SUMMARY OF THE INVENTION

Accordingly, it is an object of the present invention to provide a grooved pipe and method of filling which provides increased bowl smoke bore mouth size. Design features allowing this object to be accomplished include a V-groove plenum or an attic plenum. Advantages associated with the accomplishment of this object include a smooth, consistent draw, along with increased smoking pleasure.

It is another object of the present invention to provide a grooved pipe and method of filling whose bowl smoke bore mouth resists clogging. Design features allowing this object to be accomplished include V-groove plenum or an attic plenum communicating with a pipe bowl tobacco bore and a bowl smoke bore. Benefits associated with the accomplishment of this object include a smooth, even draw, and reduced necessity to ream out the bowl smoke bore mouth or clean same, along with the associated increase in smoking pleasure.

It is still another object of this invention to provide a grooved pipe and method of filling which provides a consistently packed tobacco fill, thereby avoiding tobacco which is packed too tightly or too loosely. Design features enabling the accomplishment of this object include a tobacco insert sized to fit into a pipe tobacco bore, a bowl tobacco bore ledge, and/or a tobacco insert plenum communicating with a bowl smoke bore. Advantages associated with the realization of this object include reduced tobacco tamping and reaming, elimination of hard draw, and reduction of the need for re-lighting the pipe.

It is another object of the present invention to provide a grooved pipe and method of filling which reduces bowl smoke bore mouth clogging when the pipe is filled. Method features allowing this object to be accomplished include the steps of tamping tobacco forward within the bowl, and tamping the tobacco opposite the bowl smoke bore mouth only in a downward direction. Benefits associated with the accomplishment of this object include reduced necessity to clean the pipe, and a more consistent draw, along with the associated enhanced smoking pleasure.

It is still another object of this invention to provide a grooved pipe and method of filling which reduces bowl smoke bore mouth clogging when the pipe is emptied. Method features allowing this object to be accomplished include the step of using a pipe tool to evacuate combustion residue in a direction away from the bowl smoke bore mouth only. Benefits associated with the accomplishment of this object include reduced necessity to clean the pipe, and a more consistent draw, along with the associated enhanced smoking pleasure.

It is yet another object of this invention to provide a grooved pipe and method of filling which is inexpensive. Design features allowing this object to be achieved include the use of components made of readily available materials. Benefits associated with reaching this objective include reduced cost, and hence increased availability to the consumer.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1 and 2. Sheet two contains FIGS. 3 and 4. Sheet three contains FIGS. 5 and 6. Sheet four contains FIGS. 7 and 8.

FIG. 1 is a side isometric view of an existing tobacco pipe design.

FIG. 2 is a side cross-sectional view of a grooved pipe incorporating a V-groove.

FIG. 7 is a side cross-sectional view of a tobacco insert about to be loaded into a tobacco pipe incorporating a bowl tobacco bore ledge.

FIG. 8 is a side cross-sectional view of an alternate embodiment tobacco insert about to be loaded into a tobacco pipe incorporating a conical bowl tobacco bore lower surface.

DETAILED DESCRIPTION OF THE PREFERRED EMBODIMENT

Figure 3:
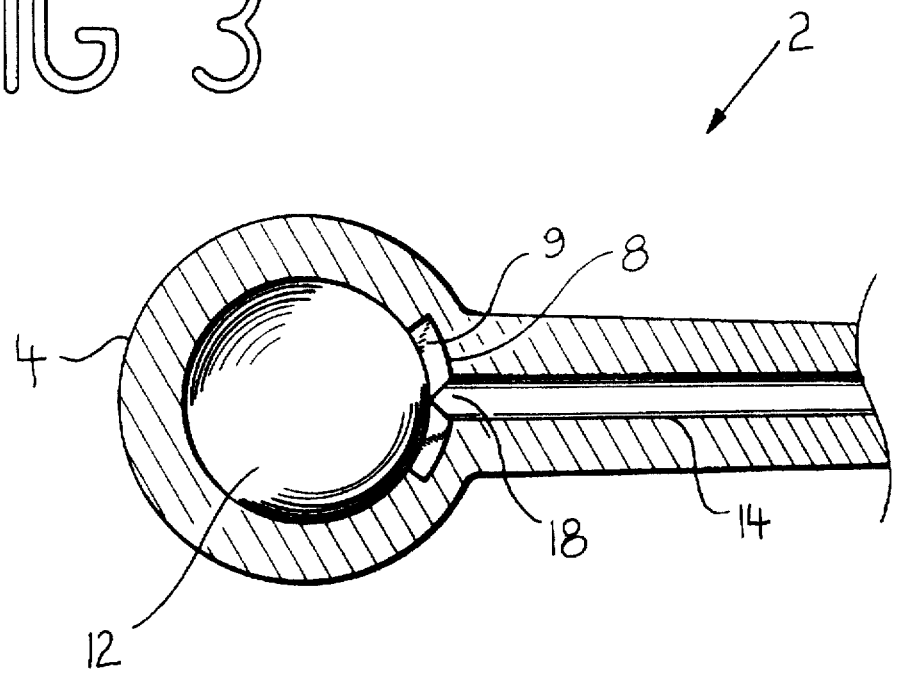
FIG. 3 is a top view of a grooved pipe incorporating a V-groove.

FIG. 2 is a side cross-sectional view of grooved pipe 2 incorporating V-groove 6 communicating with bowl smoke bore 14. Grooved pipe 2 comprises bowl 4 with bowl tobacco bore 12 terminating in bowl tobacco lower surface 56. Bowl smoke bore 14 is disposed close to bowl tobacco bore lower surface 56. As may be observed in FIG. 3 (a top view of grooved pipe 2 incorporating V-groove 6 taken at section III—III of FIG. 2), V-groove 6 extends along bowl tobacco bore 12 over an arc of approximately 70 degrees.

V-groove 6 comprises V-groove floor 9 intersecting V-groove wall 7 at V-groove apex 8. In the preferred embodiment, V-groove floor 9 intersected V-groove wall 7 at an angle of approximately 120 degrees.

V-groove floor 9 and V-groove wall 7 embrace V-groove plenum 10. As may be observed in FIG. 4, when grooved pipe 2 is filled with tobacco, V-groove plenum 10 remains tobacco-free. In this manner, the entire length of V-groove plenum 10 is exposed to tobacco 11 within bowl tobacco bore 12. This tobacco 11 exposure greatly frees the pipe draft which the smoker experiences, and helps prevent bowl smoke bore mouth 18 from clogging.

Figure 4:
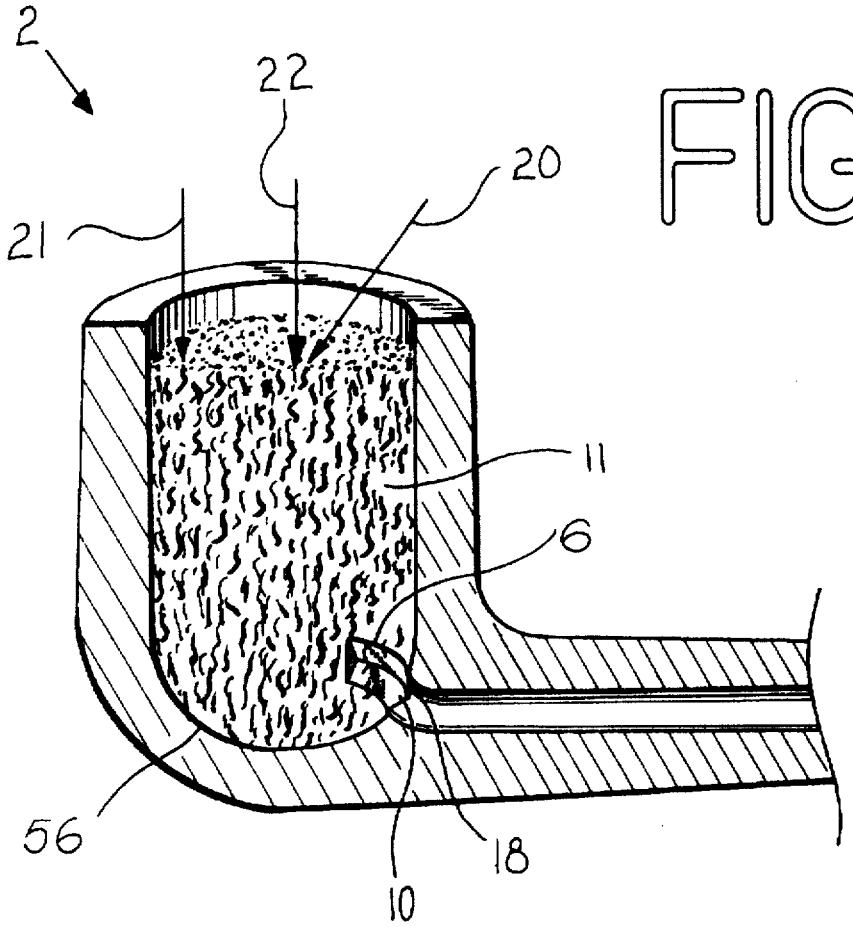
FIG. 4 is a side cross-sectional view of a grooved pipe incorporating a V-groove illustrating a filling method.

FIG. 4 is a side cross-sectional view of grooved pipe 2 incorporating V-groove 6, illustrating a method of filling grooved pipe 2 with tobacco 11. The method of filling comprises the following steps:

Method of Filling

A. Loosely fill bowl 4 with tobacco 11.

B. Tamp tobacco 11 by pressing the tobacco 11 in the center of bowl tobacco bore 12 down towards an edge of bowl tobacco bore lower surface 56 opposite bowl smoke bore mouth 18, as indicated by arrow 20.

C. Intermittently press the tobacco 11 at an edge of bowl 4 opposite bowl smoke bore mouth 18 in a downwards direction, as indicated by arrow 21.

D. Never tamp tobacco 11 downwards in the direction of bowl smoke bore mouth 18, as this may cause clogging.

E. After the tobacco 11 within bowl 4 has been sufficiently tamped, re-fill bowl 4 and repeat steps B–D as necessary (generally once or twice) until bowl 4 is full.

F. The effect of steps A–E is to leave a tobacco void in the immediate vicinity of bowl smoke bore mouth 18, thus enhancing draw and leaving bowl smoke tobacco bore mouth 18 unclogged.

G. After bowl tobacco bore 12 is satisfactorily filled, while drawing on grooved pipe 2, tamp tobacco 11 in the center of bowl tobacco bore 12 toward bowl tobacco bore lower surface 56 as indicated by arrow 22 until a small effort is required to draw. Grooved pipe 2 is now filled and ready to smoke.

Method of Emptying

A. Use a pipe tool to scrape out the byproducts of combustion by scraping along bowl tobacco bore lower surface 56 from bowl smoke bore mouth 18 in a direction directly away from bowl smoke bore mouth 18. This procedure helps maintain bowl smoke bore mouth 18 unclogged.

Figure 5:
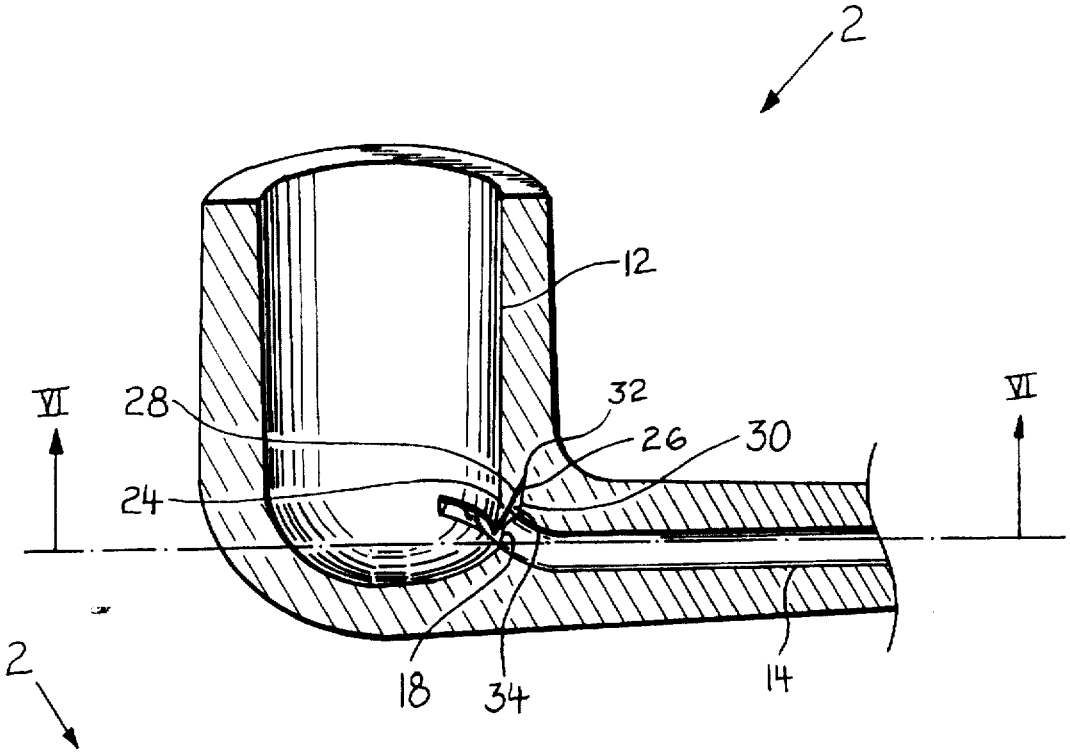
FIG. 5 is a side cross-sectional view of a grooved pipe incorporating an attic groove.
Figure 6:
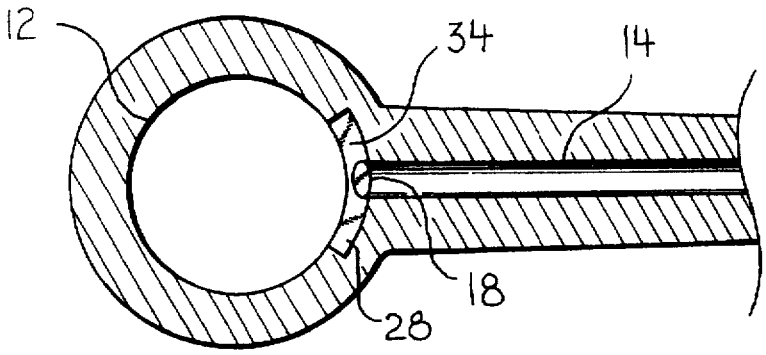
FIG. 6 is a top view of a grooved pipe incorporating an attic groove.

FIG. 5 is a side cross-sectional view of an alternate embodiment of grooved pipe 2 incorporating attic groove 26 communicating with bowl smoke bore mouth 18. As may be observed in FIG. 6 (a top view of grooved pipe 2 incorporating attic groove 26 taken at section VI—VI of FIG. 5), attic groove 26 extends along bowl tobacco bore 12 over an arc of approximately 70 degrees. Attic groove 26 comprises attic lip wall 28 which intersects attic bowl wall at attic apex 32. In the preferred embodiment, the angle between attic lip wall 28 and attic bowl wall 30 was approximately 30 degrees, and the angle between attic lip wall 28 and bowl tobacco bore 12 was approximately 30 degrees. The intersection of attic lip wall 28 and bowl tobacco bore 12 defines attic lip 24.

Attic lip wall 28 and attic bowl wall 30 embrace attic plenum 34. When grooved pipe 2 is filled with tobacco, attic plenum 34 remains tobacco-free. In this manner, the entire length of attic plenum 34 is exposed to tobacco 11 within bowl tobacco bore 12. This tobacco 11 exposure greatly smoothes and renders consistent the pipe draft which the smoker experiences, and helps prevent bowl smoke bore mouth 18 from clogging.

FIG. 7 is a side cross-sectional view of tobacco insert 40 about to be loaded into tobacco pipe 60 incorporating bowl tobacco bore ledge 52, as indicated by arrow 50. Tobacco insert 40 comprises flat tobacco insert upper surface 42, cylindrical tobacco insert body 44, and tobacco insert lower surface 46.

Tobacco insert lower surface 46 is approximately spherical so as to nest within bowl tobacco bore lower surface 56. Tobacco insert lower surface 46 is interrupted by tobacco insert cutout 48, which viewed from the side is disposed along a secant line of tobacco insert lower surface 46. Tobacco insert cutout 48 defines a tobacco insert plenum 49. When tobacco insert 40 is properly loaded (as indicated by arrow 50), tobacco insert cutout 48 is disposed adjacent bowl smoke bore mouth 18. Thus loaded, tobacco insert plenum 49 is disposed adjacent bowl smoke bore mouth 18, which keeps tobacco out of close proximity to bowl smoke bore mouth 18. Disposed adjacent bowl smoke bore mouth 18, tobacco insert plenum 49 helps prevent tobacco from clogging bowl smoke bore mouth 18, thus freeing and rendering consistent the pipe draw, and helping reduce the need to clean pipe 60.

The pipe 60 depicted in FIG. 7 shows a bowl tobacco bore 12 incorporating a bowl tobacco bore ledge 52 disposed in close proximity to bowl tobacco bore lower surface 56. Bowl tobacco bore ledge 52 supports tobacco insert 40 off of bowl tobacco bore lower surface 56, thus increasing the surface area of tobacco insert 40 exposed to bowl smoke bore mouth 18. This tobacco 11 exposure greatly frees and renders consistent the pipe draft which the smoker experiences, and helps prevent bowl smoke bore mouth 18 from clogging.

FIG. 8 is a side cross-sectional view of an alternate embodiment tobacco insert 40 about to be loaded into a tobacco pipe incorporating a conical bowl tobacco bore lower surface 56, as indicated by arrow 54. Tobacco insert 40 comprises a central core of tobacco 11 wrapped in an envelope 58. Envelope 58 is made of an appropriate combustible material such as cigarette paper, and helps tobacco insert 40 maintain its shape.

FIG. 8 depicts a bowl tobacco bore lower surface 56 shaped like an upside down cone. This bowl tobacco bore lower surface 56 configuration provides a nice, tight seal against tobacco insert 40, thus providing a smooth, even smoke to the smoker. In FIG. 8, the alternate embodiment tobacco insert 48 is shaped like a cylinder.

In the preferred embodiment, pipes 2 and 60 were manufactured of readily available pipe material such as briar root or other appropriate material. Tobacco insert 40 was made of tobacco wrapped in cigarette paper. In the alternative, tobacco insert 40 could be fashioned from a cylindrical cigar section.

While a preferred embodiment of the invention has been illustrated herein, it is to be understood that changes and variations may be made by those skilled in the art without departing from the spirit of the appending claims.

DRAWING ITEM INDEX

2 grooved pipe
4 bowl
6 V groove
7 V groove wall
8 V groove apex
9 V groove floor
10 V groove plenum
11 tobacco
12 bowl tobacco bore
14 bowl smoke bore
16 stem bore
18 bowl smoke bore mouth
20 arrow
21 arrow
22 arrow
24 attic lip
26 attic groove
28 attic lip wall
30 attic bowl wall
32 attic apex
34 attic plenum
40 tobacco insert
42 tobacco insert upper surface
44 tobacco insert body
46 tobacco insert lower surface
48 tobacco insert cutout
49 tobacco insert plenum
50 arrow
52 bowl tobacco bore ledge
54 arrow
56 bowl tobacco bore lower surface
58 envelope
60 pipe

I claim:

1. A grooved pipe comprising a bowl tobacco bore to hold tobacco, in fluid communication with a bowl smoke bore, a V-groove plenum located at an intersection of said bowl tobacco bore and said bowl smoke bore, said V-groove plenum indented within a wall of said bowl tobacco bore at the exit of said bowl tobacco bore and at the entrance of said bowl smoke bore, said V-groove plenum terminating at either extreme in a closed end, said V-groove plenum not communicating directly with the outside of said bowl tobacco bore, whereby an area of tobacco adjacent said bowl smoke bore entrance is increased, thus smoothening pipe draw, avoiding a need to re-light said grooved pipe, and preventing excessive tobacco tamping.

2. The grooved pipe of claim 1 wherein said V-groove plenum is disposed within an attic groove comprising an attic lip wall intersecting an attic bowl wall at an attic apex, said attic lip wall and said bowl tobacco bore defining an attic lip, said attic lip wall and said attic bowl wall embracing an attic plenum in communication with said bowl smoke bore mouth.

3. The grooved pipe of claim 2 wherein said attic groove extends around said bowl tobacco bore over an arc of approximately 70±25 degrees.

4. The grooved pipe of claim 2 wherein said attic lip wall is disposed at an angle of approximately 30 degrees±10 degrees to said attic bowl wall.

5. The grooved pipe of claim 4 wherein said attic lip wall is disposed at an angle of approximately 30 degrees±10 degrees to said bowl tobacco bore.

6. The grooved pipe of claim 1 further comprising a V-groove floor which is flat, thus preventing accumulation of tars and combustion byproducts on said V-groove floor.

7. The grooved pipe of claim 6 further comprising a V-groove wall intersecting said V-groove floor at a V-groove apex, said V-groove floor sloping downwards from said V-groove apex towards said pipe tobacco bore, whereby accumulation of tars and combustion byproducts on said V-groove floor is prevented.

8. The grooved pipe of claim 7 wherein said V-groove plenum extends around an arc of said bowl tobacco bore no greater than 70 degrees.

9. A cylindrical tobacco insert in combination with a pipe, said pipe comprising a bowl tobacco bore having a bowl tobacco bore lower surface, said insert inserted in said bowl, said tobacco insert comprising a tobacco insert upper surface and a tobacco insert lower surface, said tobacco insert lower surface being shaped approximately as a spherical section, whereby said tobacco insert lower surface may nest in said bowl tobacco bore lower surface said tobacco insert lower surface being interrupted by a tobacco insert cutouts which viewed from a side is disposed along a secant line of said tobacco insert lower surface, said tobacco insert cutout defining a tobacco insert plenum, said tobacco insert plenum being disposed adjacent a bowl smoke bore mouth, whereby said tobacco is kept out of close proximity to said bowl smoke bore mouth, thereby helping prevent tobacco from clogging said bowl smoke bore mouth and freeing and rendering consistent pipe draw, and helping reduce a need to clean said pipe.

* * * * *

UNITED STATES PATENT AND TRADEMARK OFFICE

CERTIFICATE OF CORRECTION

PATENT NO. : 5,746,226.
DATED : 5/5/1998.
INVENTOR(S) : George Beaver.

It is certified that error appears in the above-identified patent and that said Letters Patent is hereby corrected as shown below:

Column 6 Line 44: "...at the entrance of said..." should be "...at an entrance of said..."

Column 8 Line 4: "...surface said tobacco insert..." should be "...surface, said tobacco insert..."
Column 8 Line 5: "...insert cutouts which..." should be "...insert cutout, which..."

Signed and Sealed this

Twenty-fourth Day of November,1998

*Attest:*

BRUCE LEHMAN

*Attesting Officer*

*Commissioner of Patents and Trademarks*